US012673231B2

(12) United States Patent
Augustin et al.

(10) Patent No.: US 12,673,231 B2
(45) Date of Patent: Jul. 7, 2026

(54) COLLAPSIBLE AND ADJUSTABLE INCLINE EXERCISE BENCH AND PORTABLE WEIGHT STORAGE CONTAINER

(71) Applicant: Tempo Interactive Inc., San Francisco, CA (US)

(72) Inventors: Joshua Augustin, South San Francisco, CA (US); Moawia Eldeeb, South San Francisco, CA (US)

(73) Assignee: Tempo Interactive Inc., San Francisco, CA (US)

( * ) Notice: Subject to any disclaimer, the term of this patent is extended or adjusted under 35 U.S.C. 154(b) by 0 days.

(21) Appl. No.: 17/873,955

(22) Filed: Jul. 26, 2022

(65) Prior Publication Data

US 2023/0027387 A1 Jan. 26, 2023

Related U.S. Application Data

(60) Provisional application No. 63/225,879, filed on Jul. 26, 2021.

(51) Int. Cl.
*A63B 21/078* (2006.01)
*A63B 71/00* (2006.01)

(52) U.S. Cl.
CPC ..... *A63B 21/078* (2013.01); *A63B 71/0036* (2013.01); *A63B 2225/09* (2013.01)

(58) Field of Classification Search
CPC ..... A63B 21/078; A63B 21/4029; A63B 71/0036; A63B 2210/50; A63B 2225/09
See application file for complete search history.

(56) References Cited

U.S. PATENT DOCUMENTS 4,960,277 A 10/1990 LaRossa
6,805,409 B2 * 10/2004 Parker ..... A47C 9/002 297/316
7,294,097 B2 11/2007 Parker
(Continued)

FOREIGN PATENT DOCUMENTS

WO 2018086026 A1 5/2018

OTHER PUBLICATIONS

International Search Report and Written Opinion for corresponding International Application No. PCT/US2022/038371, mailed Jan. 26, 2023, 12 pages.

*Primary Examiner* — Joshua Lee
(74) *Attorney, Agent, or Firm* — Ahmann Kloke LLP

(57) ABSTRACT

A collapsible and adjustable incline exercise bench comprising a fixed bench frame including a first channel configured to receive a first incline support member and a second channel configured to receive a second incline support member. An adjustable incline support frame adjustably coupled to the fixed bench frame via the first incline support member and the second incline support member, at least a portion of the incline support frame configured to adjustably incline relative to the fixed bench frame via the first incline support member and the second incline support member, the incline support frame including a first portion and a second portion, and wherein the first portion and second portion are contiguous without any gap between the first portion and the second portion. A first pair of folding legs attached to the fixed bench frame. A second pair of folding legs coupled attached the fixed bench frame.

19 Claims, 13 Drawing Sheets

(56) References Cited

U.S. PATENT DOCUMENTS

| | | | | |
|---|---|---|---|---|
| 7,591,763 | B1 * | 9/2009 | Fucci | A63B 21/4013 482/52 |
| 7,651,452 | B2 | 1/2010 | Weir | |
| D610,638 | S * | 2/2010 | Friess | A63B 21/16 D21/690 |
| 9,474,923 | B2 * | 10/2016 | Davenport | A63B 21/4023 |
| 9,757,608 | B2 * | 9/2017 | Davenport | A63B 23/129 |
| D831,762 | S * | 10/2018 | Donnelly | D21/690 |
| 10,576,352 | B2 * | 3/2020 | Vester | A63B 21/4029 |
| 10,874,895 | B2 * | 12/2020 | Isom | A63B 21/0442 |
| 10,960,256 | B2 * | 3/2021 | Donnelly | A63B 21/4029 |
| 11,369,855 | B2 * | 6/2022 | Vester | A63B 21/4029 |
| 11,701,542 | B1 * | 7/2023 | Stone | A63B 21/00065 482/142 |
| 2015/0038304 | A1 * | 2/2015 | Davenport | A63B 23/1218 482/123 |
| 2017/0036058 | A1 * | 2/2017 | Davenport | A63B 22/203 |
| 2019/0151699 | A1 * | 5/2019 | Isom | A63B 21/00061 |
| 2019/0240528 | A1 * | 8/2019 | Donnelly | A63B 21/4029 |
| 2021/0016130 | A1 * | 1/2021 | Cope | A63B 21/4029 |
| 2022/0288445 | A1 * | 9/2022 | Poole | A63B 71/0036 |

* cited by examiner

COLLAPSIBLE AND ADJUSTABLE INCLINE EXERCISE BENCH AND PORTABLE WEIGHT STORAGE CONTAINER

DETAILED DESCRIPTION

Figure 1A:
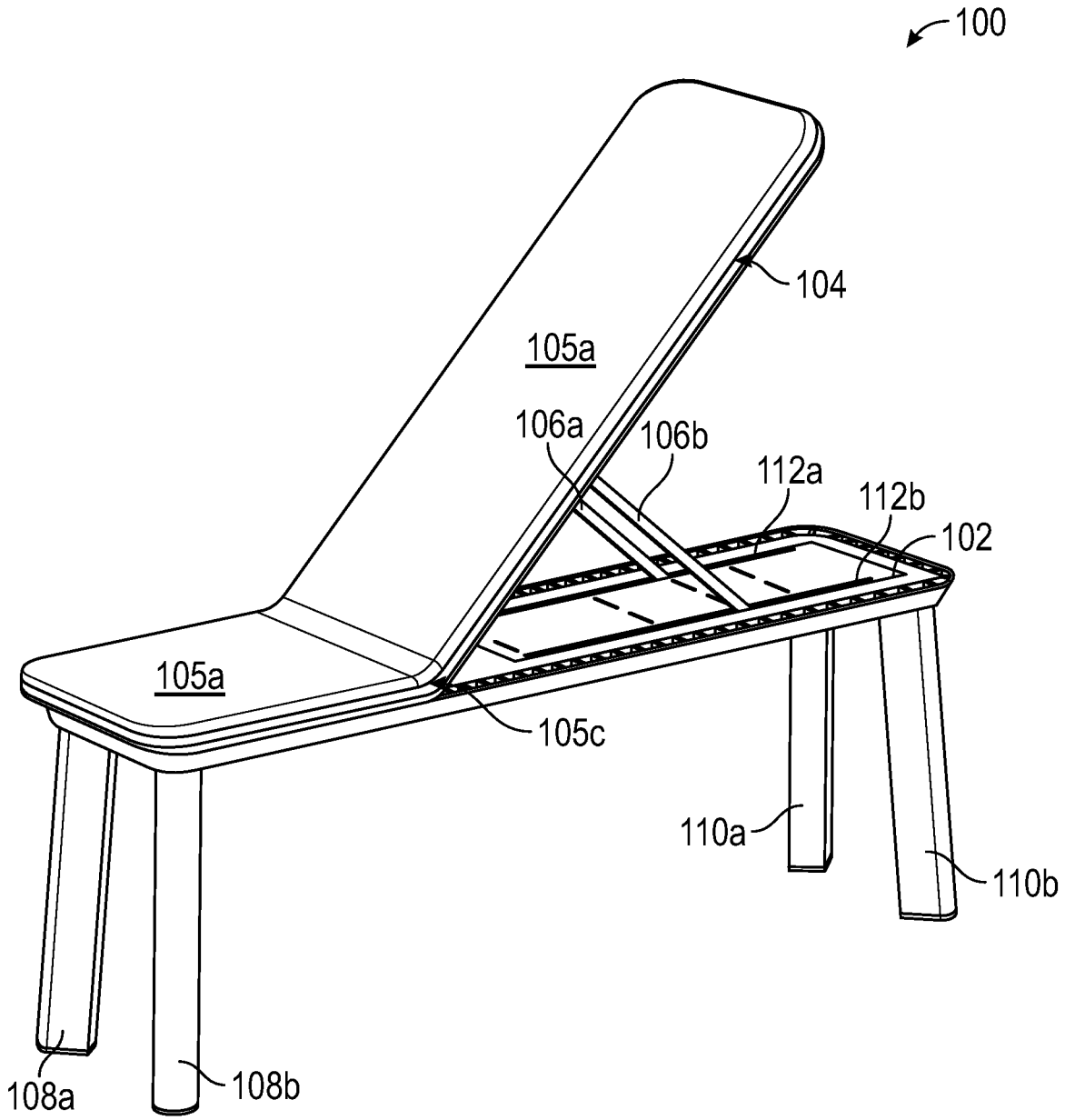
FIG. 1A depicts an example of a collapsible and adjustable incline exercise bench in an example expanded position and an example incline position.

FIG. 1A depicts an example of a collapsible and adjustable incline exercise bench 100 in an example expanded position and an example incline position. Generally, the collapsible and adjustable incline exercise bench 100 is more portable, more comfortable and more easily stored than traditional incline benches. In the example of FIG. 1A, the collapsible and adjustable incline exercise bench 100 includes a fixed bench frame 102, an adjustable incline support frame 104, incline support members 106*a-b*, a first pair of folding legs 108*a-b*, and a second pair of folding legs 110*a-b*. When the folding legs 106 and 108 are folded out (e.g., as shown here in FIG. 1A and also in FIG. 1D), that can be referred to as an expanded position. When the folding legs 106 and 108 are folded in (e.g., as shown in FIG. 1E) and the adjustable incline support frame 104 is in a flat position (e.g., a 0-degree incline and as shown in FIG. 1E), that can be referred to as a collapsed position.

In a specific implementation, the fixed bench frame 102 is configured to support the adjustable incline support frame 102 and include the folding legs 108-110 affixed thereto. The fixed bench frame 102 can be made of a rigid material (e.g., steel, aluminum, and/or polymer). In some embodiments, the fixed bench frame 102 itself is not moved (or, not capable of being moved) to achieve an incline for the collapsible and adjustable incline exercise bench 100, but rather maintains a fixed flat shape that is affixed to the folding legs 108-110. This is in contrast to traditional incline benches wherein the bench frame is manipulated in order to achieve various incline positions.

Figure 1B:
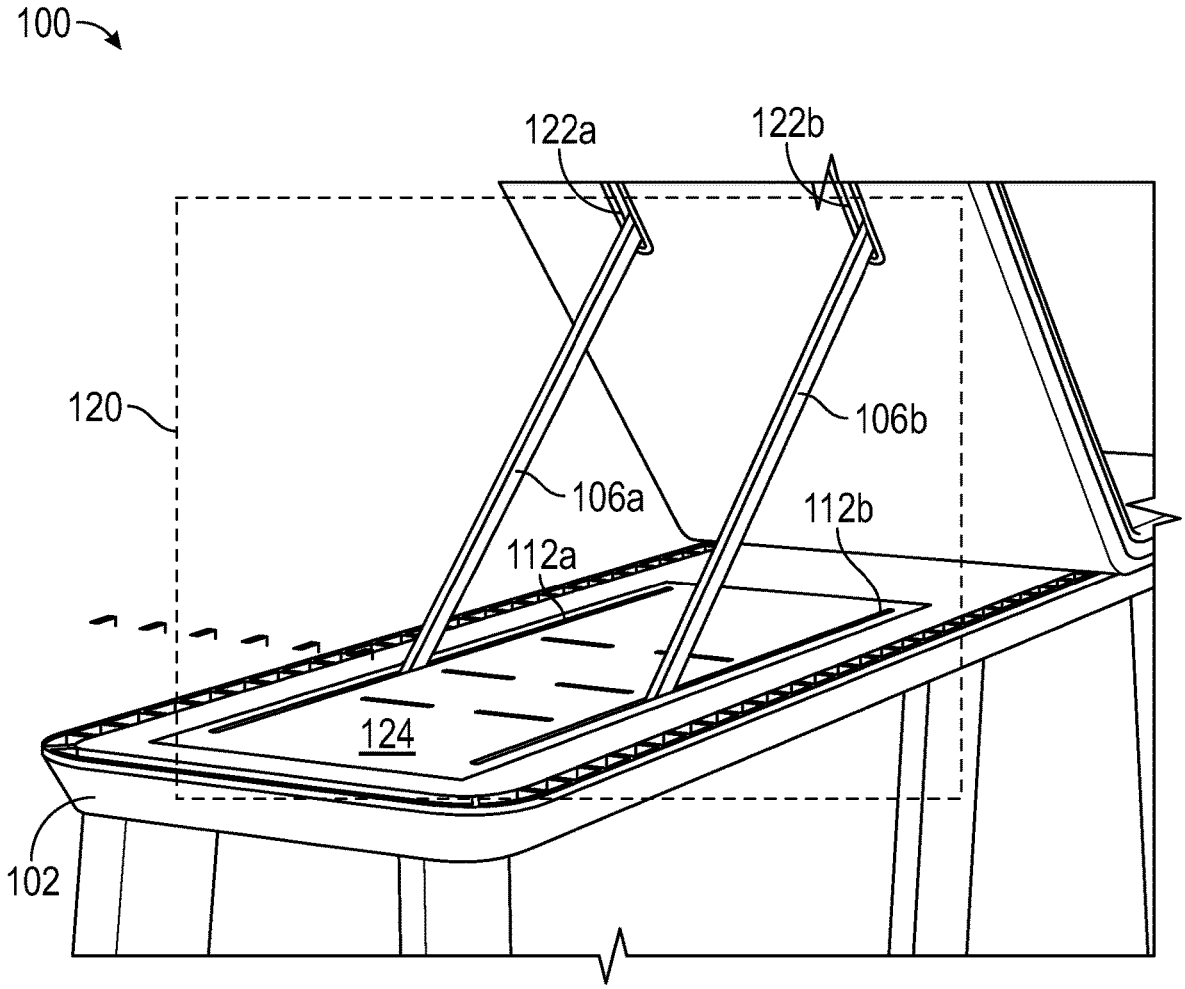
FIG. 1B depicts an example incline adjustment mechanism of a collapsible and adjustable incline exercise bench.

In a specific implementation (e.g., in order to achieve various incline positions with a fixed bench frame), the fixed bench frame 102 includes parallel channels 112*a-b* embedded along at least a portion of the fixed bench frame 102, as well as including opposing parallel channels on the adjustable incline support frame 104 (e.g., as shown and discussed further with reference to FIG. 1B). A first end of the incline support member 106*a* is positioned (e.g., adjustably affixed) within the channel 112*a*, and a second end of the incline support member 106*a* is positioned (e.g., adjustably affixed) within the opposing channel of the adjustable incline support frame 104 (e.g., as shown and discussed further with reference to FIG. 1B). Similarly, a first end of the incline support member 106*b* is positioned (e.g., adjustably affixed) within the channel 112*b*, and a second end of the incline support member 106*b* is positioned (e.g., adjustably affixed) within the opposing channel of the adjustable incline support frame 104 (e.g., as shown and discussed further with reference to FIG. 1B). The adjustable incline support frame 104 can be positioned (e.g., locked) at various incline levels by the incline support members 106 sliding, or otherwise moving, to various positions (e.g., a 30-degree position, a 45-degree position, a 60-degree position) in their respective channels 112. For example, the incline support members 106 can be configured to slide, or otherwise move, through the corresponding channels on the fixed bench frame 102 and/or channels of the adjustable incline support frame 104. The incline support members 106 can be made of a rigid material, such as steel, aluminum, titanium, polymer, and/or the like. In a specific implementation, the incline support members 106 can be positioned at predetermined incline levels (e.g., a 30-degree position, a 45-degree position, a 60-degree position), and/or any incline level along the channels 112 (e.g., 31.3-degree position, 42-degree position).

In a specific implementation, the adjustable incline support frame 104 is configured to support a user's body during exercise. For example, a user can sit on a first portion 105*a* of the adjustable incline support frame 104 and lean their back or stomach against a second portion 105*b* of the adjustable incline support frame 104.

In a specific implementation, the adjustable incline support frame 104 has continuous surfaces (e.g., outer surface(s), top surface, bottom surface, sides surfaces) without any gaps, and can be, or appear to be, a single unified structure and/or a single material. Thus, for example, there is no gap between the first portion 105*a* of the adjustable incline support frame 104 and the second portion 105*b* of the adjustable incline support frame 104. This can, for example, provide increased user comfort relative to traditional incline benches which typically have a gap between the portion a user sits on a portion that the user leans on. This structure of the collapsible and adjustable incline exercise bench 100 can also provide increased portability when the collapsible and adjustable incline exercise bench 100 is in a collapsed position because, for example, the collapsible and adjustable incline exercise bench 100 is more compact since it does not have such aforementioned gaps, and therefore has a more compact structure.

In a specific implementation, the adjustable incline support frame 104 is flexible (e.g., capable of hinging) at one or more points of the adjustable incline support frame 104. For example, the adjustable incline support frame 104 can hinge at location 105*c* of the adjustable incline support frame 104 to achieve various levels of incline relative to the fixed bench frame 102. The flexibility at the one or more points of the adjustable incline support frame 104 can allow the collapsible and adjustable incline exercise bench 104 to achieve incline positions without any gaps between the first portion 105*a* of the adjustable incline support frame 104 and the second portion 105*b* of the adjustable incline support frame 104, which can, for example, increase user comfort relative to traditional incline benches.

In a specific implementation, the adjustable incline support frame 104 comprises one or more layers of padding or other material suitable for comfortably supporting a user body. For example, a soft layer (e.g., foam layer) may be positioned between two semi-rigid or flexible layers (e.g., rubber, plastic, and/or the like). In one example, the adjustable incline support frame 104 comprises flexible material (e.g., padding) that allows the adjustable incline support frame 104 to be adjusted to various incline levels. In another example, the adjustable incline support frame 104 can include one or more components (e.g., a hinge mechanism(s)) within the adjustable incline support frame 104 that allows the adjustable incline support frame 104 to be adjusted to various incline levels.

In a specific implementation, at least a portion of the adjustable incline support frame 104 is adjustably coupled (or, affixed or attached) to the fixed bench frame 102. For example, the first portion 105*a* of adjustable incline support frame 104 can be affixed to the fixed bench frame 102, while the second portion 105*b* of the adjustable incline support frame 104 can be moved to various incline positions, such as between lying flush against the fixed bench frame 102 (e.g., a in a flat position) to various incline positions.

In a specific implementation, the first portion 105*a* of the adjustable incline support frame and the second portion 105*a* of the adjustable incline support frame 104 comprises a single continuous or contiguous component (e.g., without any gaps in an outer surface), although in other implementations, they can be different components that are connected (e.g., by a hinge) such that the adjustable incline support frame 104 appears to be a single continuous contiguous component (e.g., without any gaps in an outer surface).

In a specific implementation, the collapsible and adjustable incline exercise bench 100 includes two pairs of folding legs 108*a-b* and 110*a-b*. In the example of the FIG. 1A, the folding legs 108*a-b* and 110*a-b* are shown in an expanded position. The folding legs 108*a-b* and 110*a-b* can be folded inwards in order to collapse the collapsible and adjustable incline exercise bench 100 (e.g., as shown in FIG. 1D), and the folding legs 108*a-b* and 110*a-b* can be folded outwards in order to expand the collapsible and adjustable incline exercise bench 100, as shown in FIG. 1A.

FIG. 1B depicts an example incline adjustment mechanism 120 of a collapsible and adjustable incline exercise bench 100. In the example of FIG. 1B, an example rear-view of the collapsible and adjustable incline exercise bench 100 is shown (e.g., as opposed to the example front-view shown in FIG. 1A). The incline adjustment mechanism 120 includes a third channel 122*a* and a fourth channel 122*b*, as well as the first channel 112*a* and the second channel 112*b* in an incline setting frame 124 of the fixed bench frame 102, the first the incline support member 106*a*, and the second incline support member 106*b*.

In a specific implementation, the incline support members 106*a-b* can slide, or otherwise move, through channels 112*a-b* and/or the channels 112*a-b* in order to provide an incline position or flat position for the adjustable incline support frame 104. In some embodiments, a user can use predetermined incline settings (e.g., as set on the frame 124) to set an incline setting. In some embodiments, a user can dynamically set an incline setting that is not labeled on the incline setting frame 124. For example, the incline support members 106*a-b* can be positioned (or, locked) at any point along the channels to dynamically set a user-specified incline setting. For example, the incline support members 106*a-b* can include a first portion of an incline locking mechanism that can be mated without a second portion of an incline locking mechanism in a respective channel(s) 112 and/or 122 (e.g., at the predetermined settings and/or along any other portion of the channel(s) 112 and/or 122.

Figure 1C:
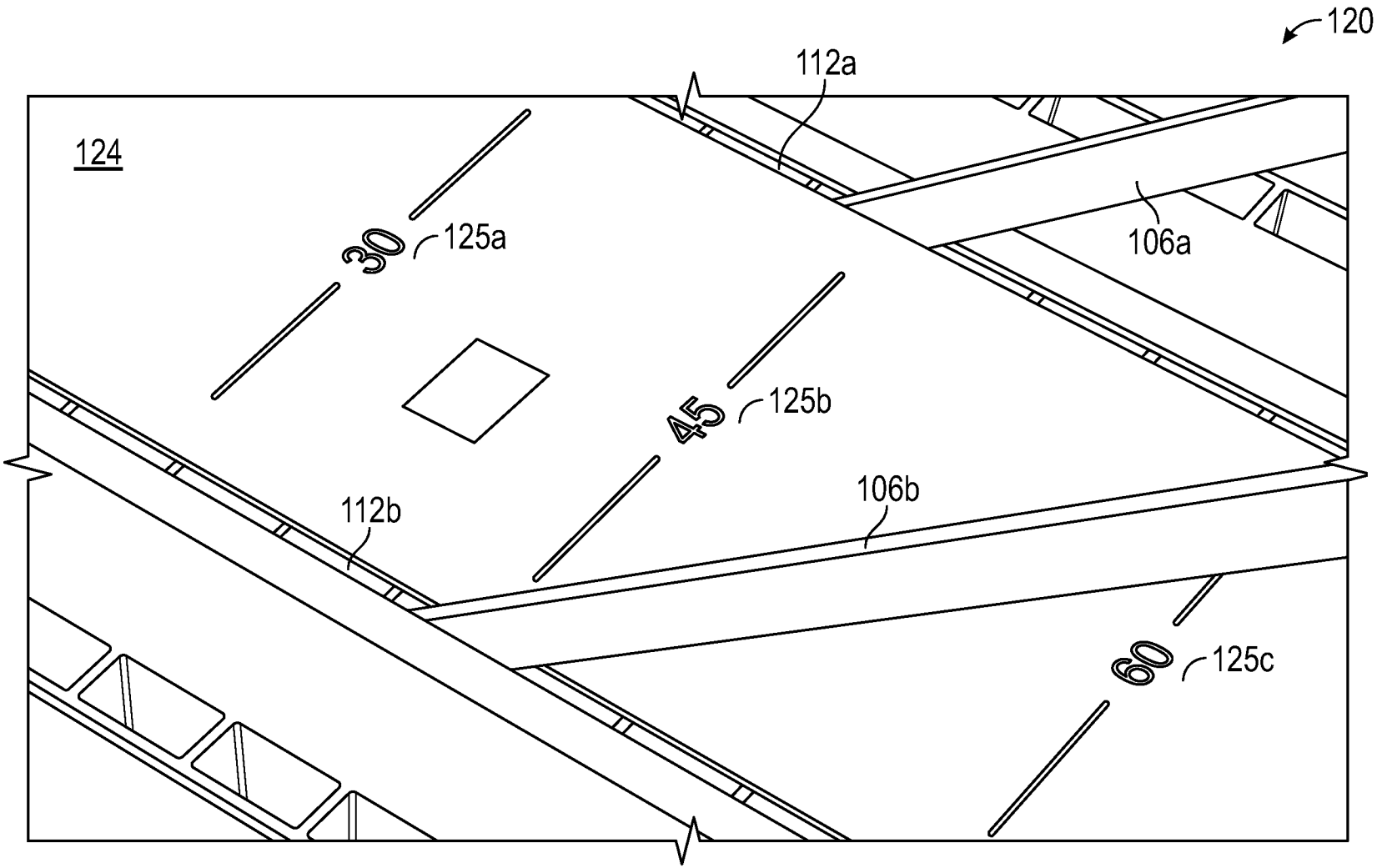
FIG. 1C depict example incline settings of an incline setting frame of an incline adjustment mechanism of a collapsible and adjustable incline exercise bench.
Figure 1D:
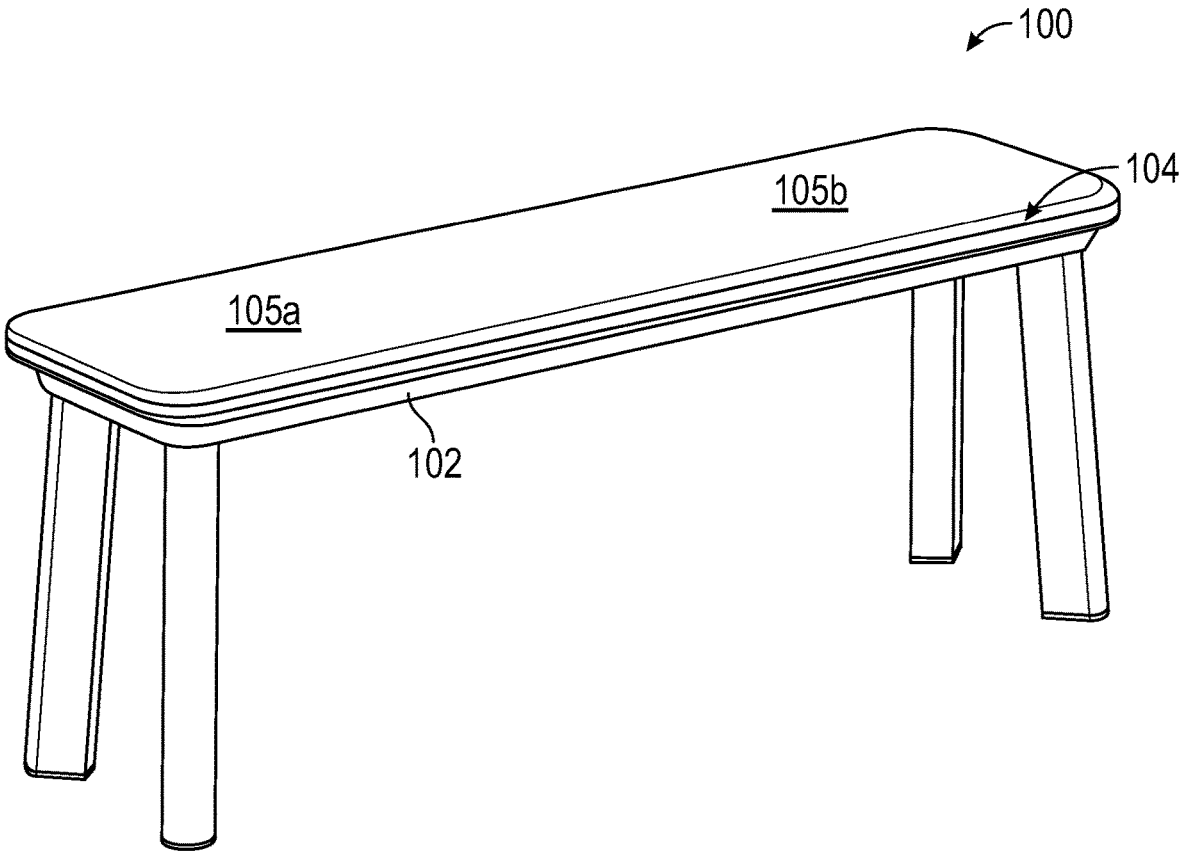
FIG. 1D depicts an example of a collapsible and adjustable incline exercise bench in an example expanded flat position.
Figure 1E:
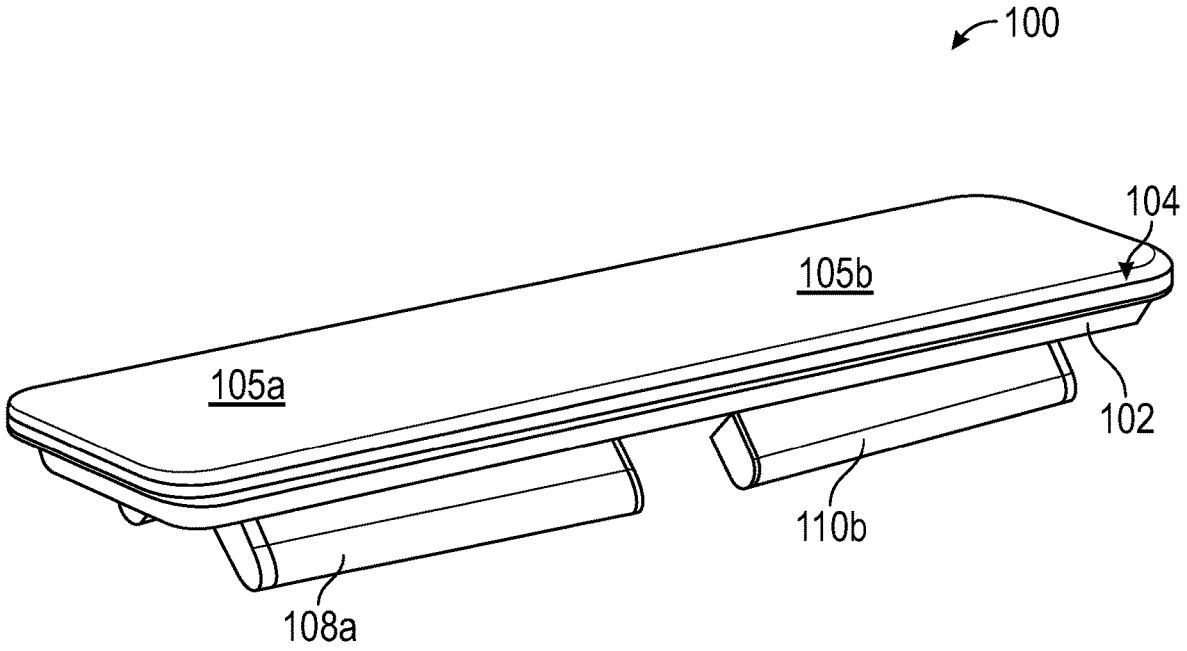
FIG. 1E depicts an example of a collapsible and adjustable incline exercise bench in an example collapsed position and an example flat position.

FIG. 1C depict example incline settings 125*a-c* of an incline setting frame 124 of an incline adjustment mechanism 120 of a collapsible and adjustable incline exercise bench 100. In the example of FIG. 1C, the incline settings include a 30-degree incline setting 124, a 45-degree incline setting 124*b*, and a 60-degree incline setting 124*c*. Of course, it will be appreciated that these are shown as examples, and that other settings (e.g., predetermined settings) may also be included, and that, in some embodiments, a user can dynamically set an incline setting that is not labeled on the incline setting frame 124. For example, the incline support members 106*a-b* can be positioned (or, locked) at any point along the channels to dynamically set a user-specified incline setting. For example, the incline support members 106*a-b* can include a first portion of an incline locking mechanism that can be mated without a second portion of an incline locking mechanism in a respective channel(s) 112 and/or 122 (e.g., at the predetermined settings and/or along any other portion of the channel(s) 112 and/or 122.

FIG. 1D depicts an example of a collapsible and adjustable incline exercise bench 100 in an example expanded flat position. As shown, the adjustable incline support frame 104 appears flat and appears to be single structure that is indistinct from a typical flat bench, as opposed to an incline bench. In a specific implementation, the adjustable incline support frame 104 can also have similar (e.g., within several inches in one or more dimensions) dimensions as the fixed bench frame 102. Also, as shown, and discussed elsewhere herein, there is no gap between first portion 105*a* of the adjustable incline support frame 104 and the second portion 105*b* of the adjustable incline support frame 104, thus retaining the single or continuous or contiguous structure and/or appearance.

FIG. 1E depicts an example of a collapsible and adjustable incline exercise bench 100 in an example collapsed flat position. As shown, the folding legs 108 and 110 are folded underneath the fixed bench frame 102 and the adjustable incline support frame 104, to provide a compact structure without any unnecessary gaps (e.g., between first portion 105*a* of the adjustable incline support frame 104 and the second portion 105*b* of the adjustable incline support frame 104). While in this collapsed flat position, the collapsible and adjustable incline exercise bench 100 can be more easily moved and stored than traditional inline benches.

Figure 1F:
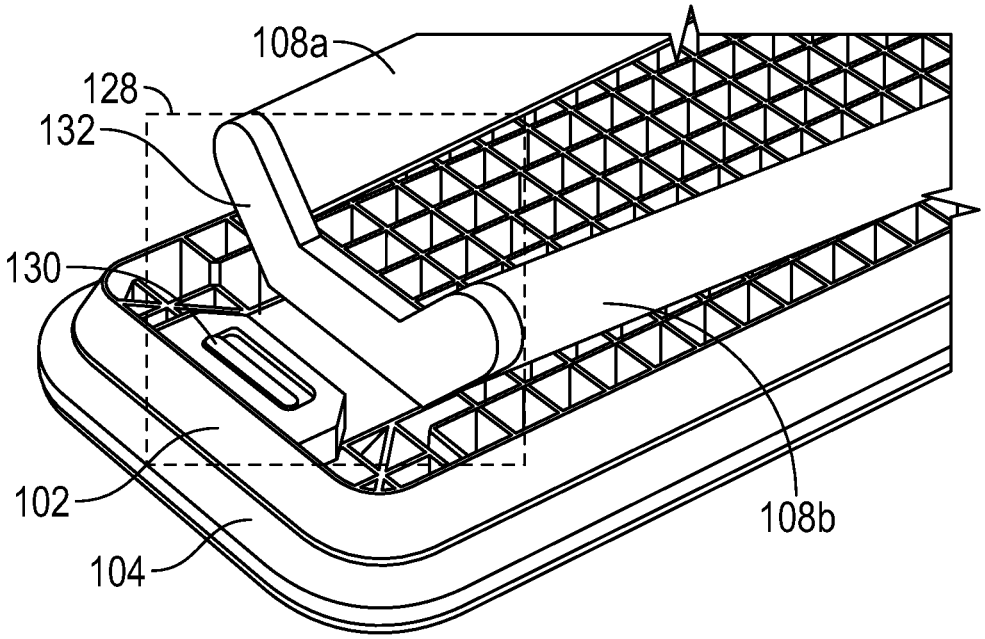
FIG. 1F depicts an example folding mechanism of a collapsible and adjustable incline exercise bench in an example collapsed flat position.
Figure 1G:
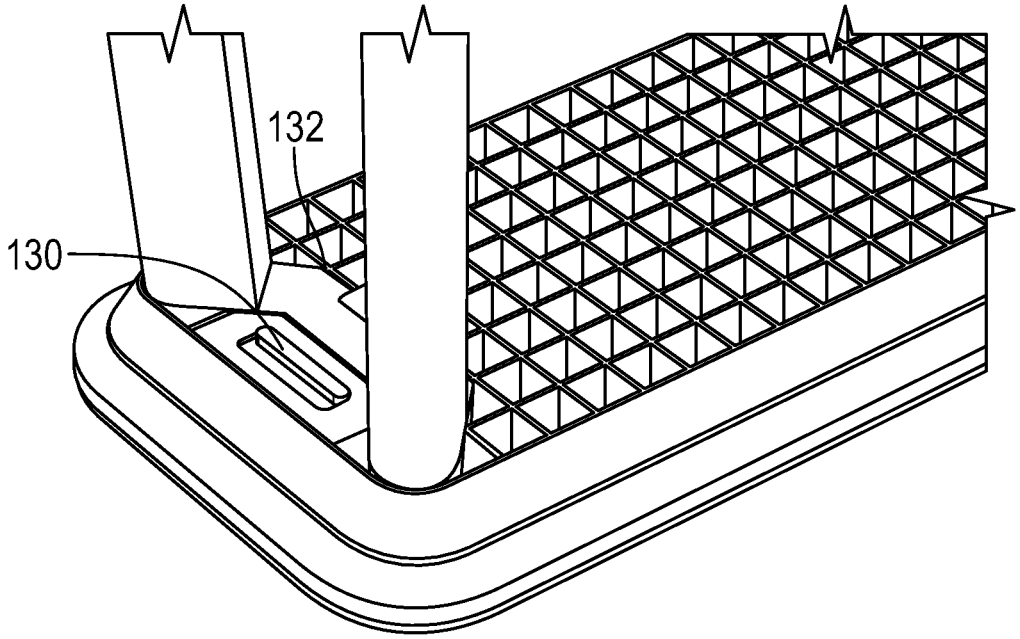
FIG. 1G depicts an example locking mechanism of a collapsible and adjustable incline exercise bench in an example expanded flat position.

FIG. 1F depicts an example folding mechanism 128 of a collapsible and adjustable incline exercise bench 100 in an example collapsed flat position. In the example of FIG. 1F, the folding mechanism 128 includes a folding lock mechanism 130 and a folding support member 132 affixed to the folding legs 108*a-b* (or folding legs 110*a-b* if the folding mechanism 128 is located on the opposite end of the collapsible and adjustable incline exercise bench 100). It will be appreciated that the other pair of folding legs 110*a-b* can also include a similar folding mechanism 128. In a specific implementation, the folding lock mechanism 130 is positioned such that the folding legs 108*a-b* are unlocked and can be moved to an expanded position. For example, the folding mechanism 132 allows the folding legs 108*a-b* to be folded outward together and then locked in place by the sliding the folding lock mechanism 130 to a locked position, thereby locking the expanded position (e.g., as shown in FIG. 1G).

Figure 2:
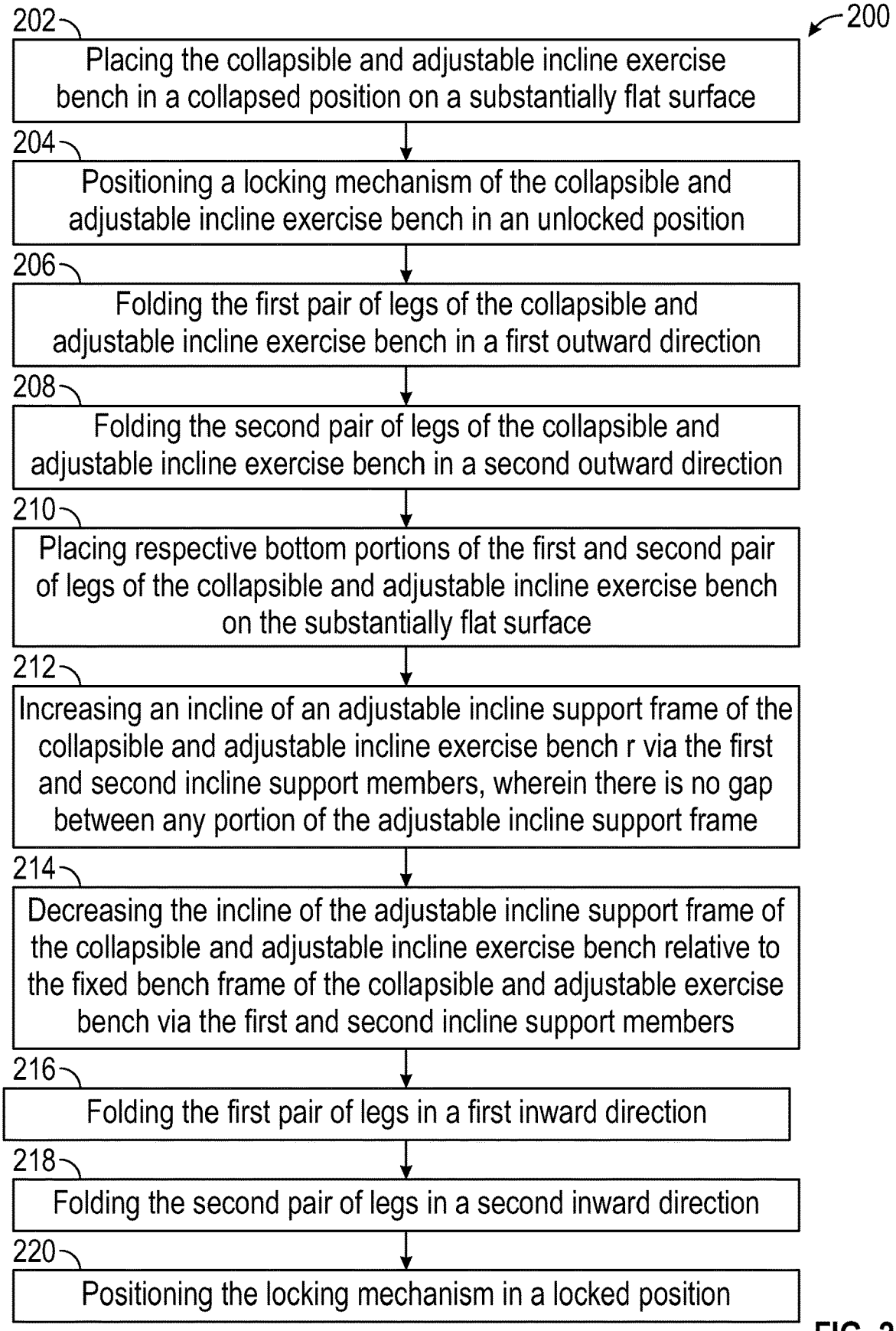
FIG. 2 is a flowchart of an example of a method of expanding, adjusting, and collapsing a collapsible and adjustable incline exercise bench.

FIG. 2 is a flowchart 200 of an example of a method of expanding, adjusting, and collapsing a collapsible and adjustable incline exercise bench. In this and other flowcharts and/or sequence diagrams, the flowchart illustrates by way of example a sequence of modules. It should be understood the modules may be reorganized for parallel execution, or reordered, as applicable. Moreover, some modules that could have been included may have been removed to avoid providing too much information for the sake of clarity and some modules that were included could be removed but may have been included for the sake of illustrative clarity.

In module 202, a user places a collapsible and adjustable incline exercise bench in a collapsed position (e.g., as shown in FIG. 1D) on a substantially flat surface. For example, and as discussed elsewhere herein, the collapsible and adjustable incline exercise bench can include a fixed bench frame including a first channel configured to receive a first incline support member and a second channel configured to receive a second incline support member; an adjustable incline support frame adjustably coupled to the fixed bench frame via the first incline support member and the second incline support member, the incline support frame configured to support at least a portion of a user's body, and at least a portion of the incline support frame configured to adjustably incline relative to the fixed bench frame via the first incline support member and the second incline support member, the incline support frame including a first portion for the user to sit on and a second portion for the user to lean against, and wherein the first portion and second portion are contiguous without any gap between the first portion and the second portion; a first pair of folding legs attached to the fixed bench frame; and a second pair of folding legs coupled attached the fixed bench frame.

In a specific implementation, the adjustable incline support frame has a continuous outer surface.

In a specific implementation, the adjustable incline support frame includes a third channel configured to receive the first incline support member and a fourth channel configured to receive the second incline support member.

In a specific implementation, the first incline support member is configured to slide through the first channel and the second incline support member is configured to slide through the second channel.

In a specific implementation, the first incline support member is configured to slide through the third channel and the second incline support member is configured to slide through the fourth channel.

In a specific implementation, the fixed bench frame includes predetermined settings for a plurality of different incline levels.

In a specific implementation, the fixed bench frame can be dynamically set to different user specified incline levels. For example, the incline support members can be locked (e.g., via pins, plungers, or other locking mechanism) at any point along the aforementioned channels.

In a specific implementation, the fixed bench frame further comprises a locking mechanism capable of locking the first and second pairs of folding legs in a locked and collapses position.

In a specific implementation, the fixed bench frame further comprises a locking mechanism capable of locking the first and second pairs of folding legs in a locked and collapses position.

In a specific implementation, the fixed bench frame further comprises a locking mechanism capable of locking the first and second pairs of folding legs in a locked and expanded position.

In a specific implementation, the collapsible and adjustable incline exercise bench further comprises a first folding mechanism and a second folding mechanism.

In a specific implementation, the first folding mechanism is configured to fold the first pair of folding legs, and the second folding mechanism is configured to fold the second pair of folding legs.

In module 204, the user positions a locking mechanism of the collapsible and adjustable incline exercise bench in an unlocked position.

In module 206, the user folds the first pair of legs of the collapsible and adjustable incline exercise bench in a first outward direction.

In module 208, the user folds the second pair of legs of the collapsible and adjustable incline exercise bench in a second outward direction.

In module 210, the user places respective bottom portions of the first and second pair of legs of the collapsible and adjustable incline exercise bench on the substantially flat surface.

In module 212, the user increases an incline of an adjustable incline support frame of the collapsible and adjustable incline exercise bench relative to a fixed bench frame of the collapsible and adjustable incline exercise bench via the first and second incline support members, wherein there is no gap between any portion of the adjustable incline support frame.

In module 214, the user decreases the incline of the adjustable incline support frame of the collapsible and adjustable incline exercise bench relative to the fixed bench frame of the collapsible and adjustable exercise bench via the first and second incline support members.

In module 216, the user folds the first pair of legs in a first inward direction.

In module 218, the user folds the second pair of legs in a second inward direction.

In module 220, the user positions the locking mechanism in a locked position.

Figure 3A:
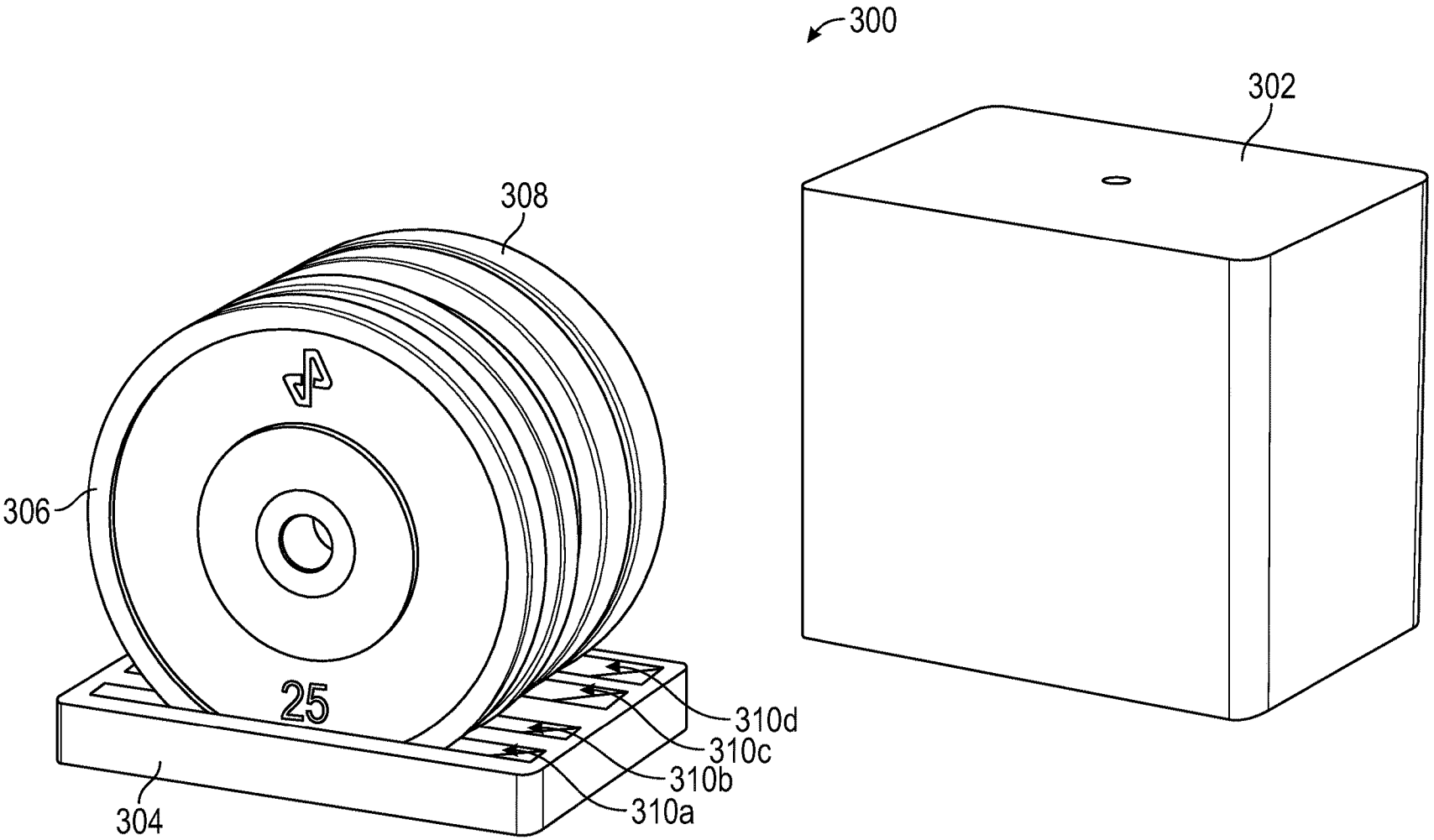
FIG. 3A depicts an example of an unpacked portable weight storage container.

FIG. 3A depicts an example of an unpacked portable weight storage container 100. As shown, the portable weight storage container 300 includes a container housing 302 and a tray 304 configured to store weight plates 306-308.

Figure 3B:
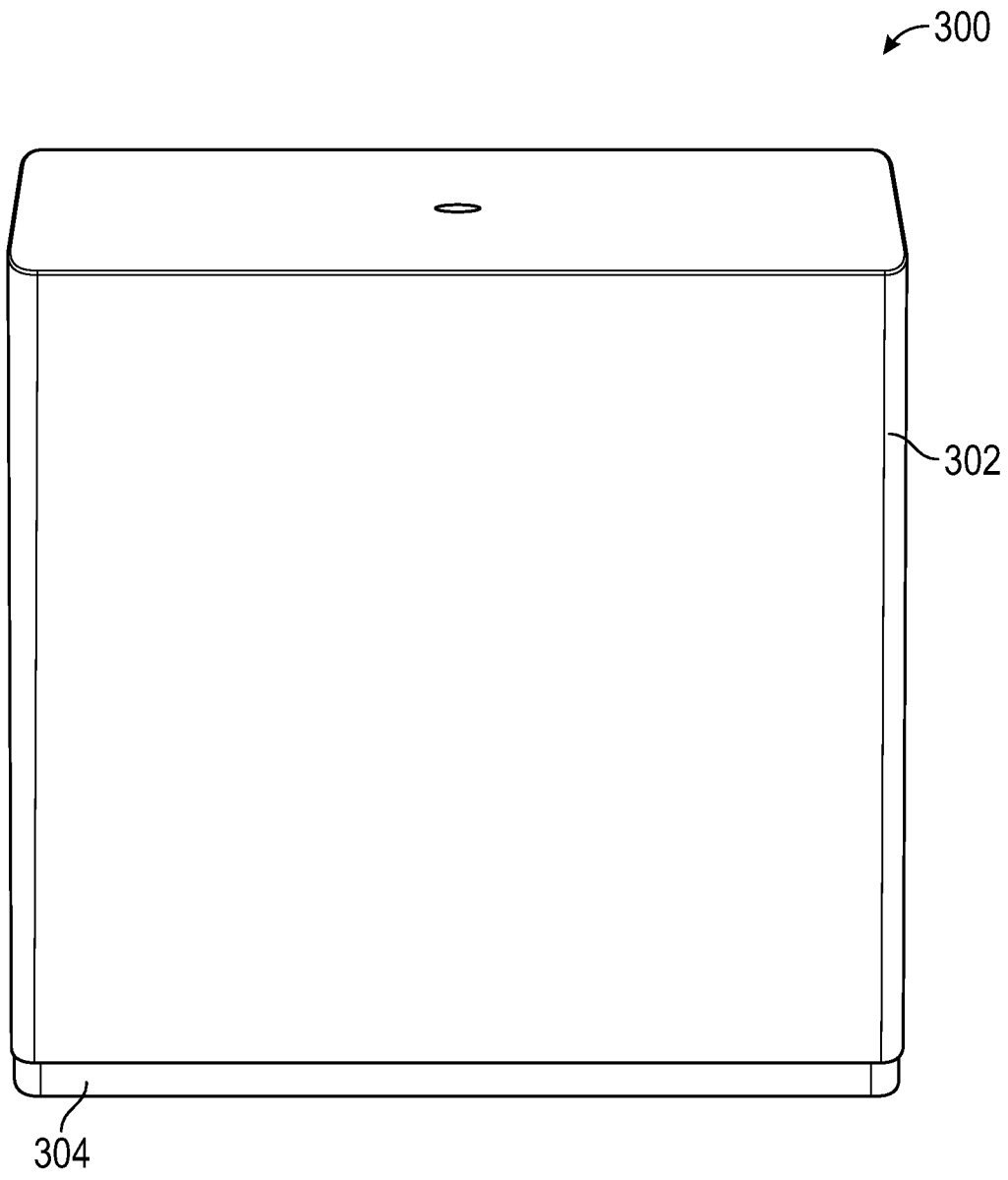
FIG. 3B depicts an example of a packed portable weight storage container.
Figure 6:
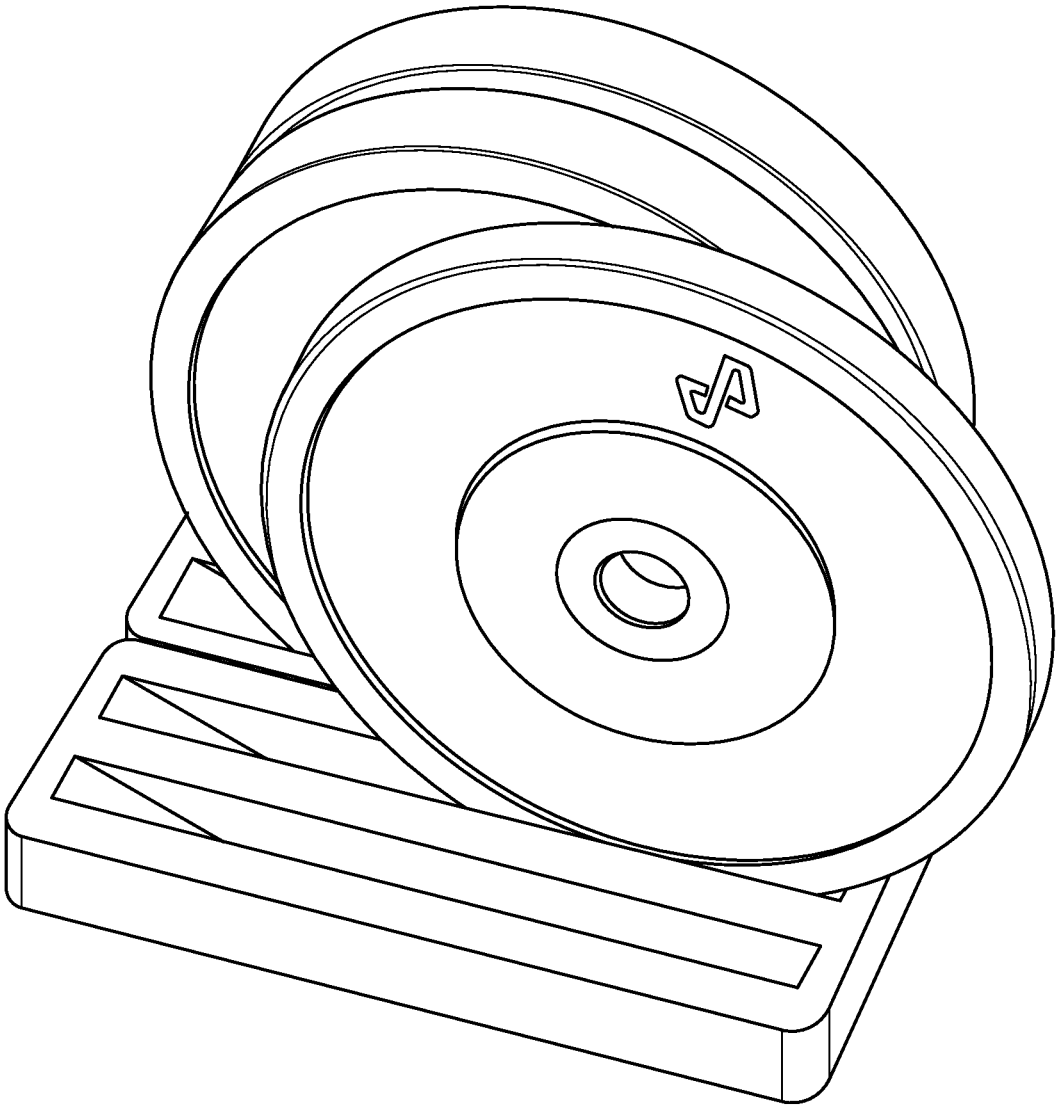
FIG. 6 depicts an example weight plate removal from an example double tray of a portable weight storage container.

In a specific implementation, the tray 304 is configured to store four weight plates (e.g., barbell weight plates, dumbbell weight plates), although other implementations include weights tray configured to hold a larger or smaller number of such weight plates. As shown, the weight tray 304 includes recessed and curved slots 310*a-d* that are each configured to receive and store a corresponding weight plate 306. The curvature of the recessed and curved slots 310 allows weight plates 306-308 to be easily inserted and removed (e.g., as shown in FIG. 6). For example, rather than having to insert a weight plate 306 in a very specific location (e.g., on a peg of stand 4-*ft* off the ground), a user can merely place a weight plate 306 or 308 on any part of a slot 310 and the weight plate will automatically fall into place. Similarly, in order to remove a weight plate 306 or 308 from the tray 304, the user can roll the plate off the tray 304 using the recessed curvature of the slot 310. Accordingly, the user is required to exert less effort to insert and remove weight plates than on traditional weight stands. A user may secure the weight plates 306 and 308 by placing the container housing 302 over the weight plates 306 and the weight tray 304 (e.g., as shown in FIG. 3B).

In a specific implementation, the curvature of the recessed and curved slots 310 can also allow different weights (e.g., 25-lb and 45-lb) to be stored in the tray 304. In a specific implementation, the curvature of the recessed and curved slots 310 is the same for each of the slots 310, and that curvature allows different weights to be stored in the tray 304.

Figure 4:
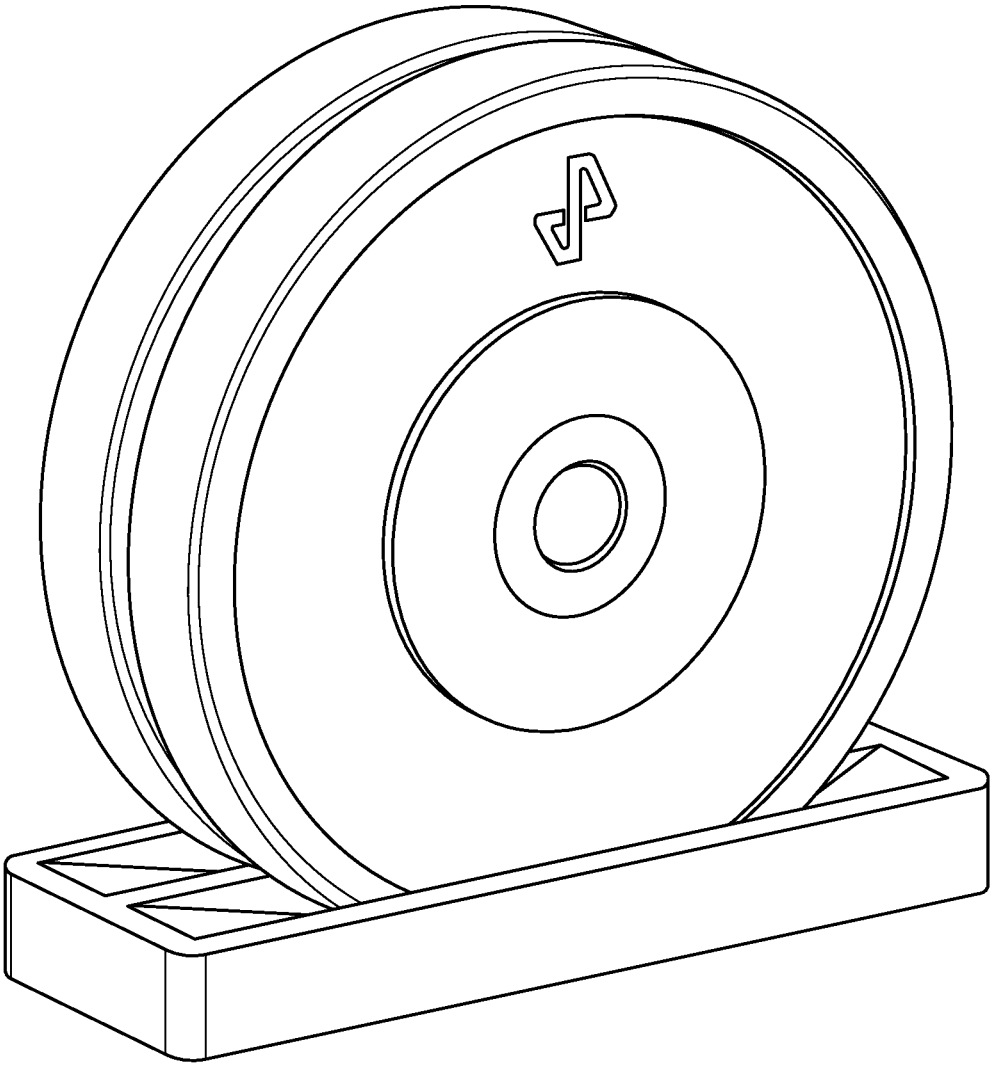
FIG. 4 depicts an example single tray of a portable weight storage container.
Figure 5:
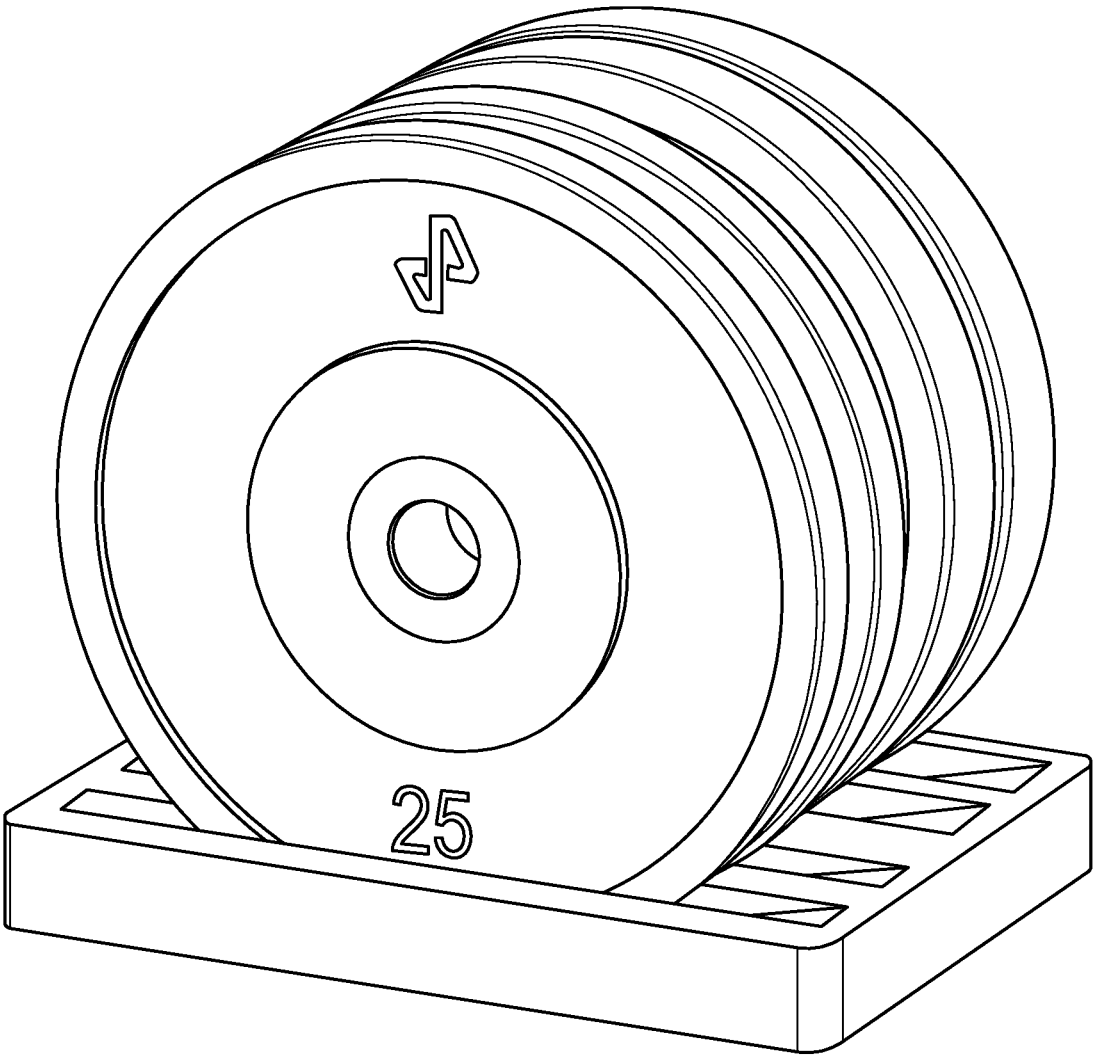
FIG. 5 depicts an example double tray of a portable weight storage container.

As discussed above, the tray 304 can have various configurations. For example, a single tray 400 configured to store two weight plates 402 is shown in FIG. 4. In another example, a double tray 500 configured to store four weight plates is shown in FIG. 5, as well as in FIG. 3A.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

The present invention(s) are described above with reference to example embodiments. It will be apparent to those skilled in the art that various modifications may be made, and other embodiments may be used without departing from the broader scope of the present invention(s). Therefore, these and other variations upon the example embodiments are intended to be covered by the present invention(s).

What is claimed is:

1. A collapsible and adjustable incline exercise bench comprising:

a fixed bench frame including a first channel configured to receive a first incline support member and a second channel configured to receive a second incline support member;

an adjustable incline support frame adjustably coupled to the fixed bench frame via the first incline support member and the second incline support member, the adjustable incline support frame configured to support at least a portion of a user's body, and at least a portion of the adjustable incline support frame configured to adjustably incline relative to the fixed bench frame via the first incline support member and the second incline support member, the adjustable incline support frame including a first portion for the user to sit on and a second portion for the user to lean against, wherein the first portion and the second portion are contiguous without any gap between the first portion and the second portion, and wherein the first portion and the second portion are part of a single contiguous component;

a first pair of folding legs attached to the fixed bench frame; and a second pair of folding legs attached to the fixed bench frame.

2. The collapsible and adjustable incline exercise bench of claim 1, wherein the adjustable incline support frame has a continuous outer surface.

3. The collapsible and adjustable incline exercise bench of claim 1, wherein the adjustable incline support frame includes a third channel configured to receive the first incline support member and a fourth channel configured to receive the second incline support member.

4. The collapsible and adjustable incline exercise bench of claim 3, wherein the first incline support member is configured to slide through the first channel and the second incline support member is configured to slide through the second channel.

5. The collapsible and adjustable incline exercise bench of claim 4, wherein the first incline support member is configured to slide through the third channel and the second incline support member is configured to slide through the fourth channel.

6. The collapsible and adjustable incline exercise bench of claim 1, wherein the fixed bench frame includes predetermined settings for a plurality of different incline levels.

7. The collapsible and adjustable incline exercise bench of claim 1, wherein the fixed bench frame further comprises a locking mechanism capable of locking the first and second pairs of folding legs in a locked and collapsed position.

8. The collapsible and adjustable incline exercise bench of claim 1, wherein the fixed bench frame further comprises a locking mechanism capable of locking the first and second pairs of folding legs in a locked and expanded position.

9. The collapsible and adjustable incline exercise bench of claim 1, further comprising a first folding mechanism and a second folding mechanism.

10. The collapsible and adjustable incline exercise bench of claim 9, wherein the first folding mechanism is configured to fold the first pair of folding legs, and the second folding mechanism is configured to fold the second pair of folding legs.

11. A method of expanding, adjusting, and collapsing a collapsible and adjustable incline exercise bench, the method comprising:

placing the collapsible and adjustable incline exercise bench in a collapsed position on a substantially flat surface, the collapsible and adjustable incline exercise bench including:

a fixed bench frame including a first channel configured to receive a first incline support member and a second channel configured to receive a second incline support member;

an adjustable incline support frame adjustably coupled to the fixed bench frame via the first incline support member and the second incline support member, the adjustable incline support frame configured to support at least a portion of a user's body, and at least a portion of the adjustable incline support frame configured to adjustably incline relative to the fixed bench frame via the first incline support member and the second incline support member, the adjustable incline support frame including a first portion for the user to sit on and a second portion for the user to lean against, wherein the first portion and the second portion are contiguous without any gap between the first portion and the second portion, and wherein the first portion and the second portion are part of a single contiguous component;

a first pair of folding legs attached to the fixed bench frame; and a second pair of folding legs attached to the fixed bench frame;

positioning a locking mechanism of the collapsible and adjustable incline exercise bench in an unlocked position;

folding the first pair of folding legs of the collapsible and adjustable incline exercise bench in a first outward direction;

folding the second pair of folding legs of the collapsible and adjustable incline exercise bench in a second outward direction;

placing respective bottom portions of the first and second pairs of folding legs of the collapsible and adjustable incline exercise bench on the substantially flat surface;

increasing an incline of the adjustable incline support frame of the collapsible and adjustable incline exercise bench relative to the fixed bench frame of the collapsible and adjustable incline exercise bench via the first and second incline support members, wherein there is no gap between the first portion and the second portion;

decreasing the incline of the adjustable incline support frame of the collapsible and adjustable incline exercise bench relative to the fixed bench frame of the collapsible and adjustable exercise bench via the first and second incline support members;

folding the first pair of folding legs in a first inward direction;

folding the second pair of folding legs in a second inward direction; and positioning the locking mechanism in a locked position.

12. The method of claim 11, wherein the adjustable incline support frame has a continuous outer surface.

13. The method of claim 11, wherein the adjustable incline support frame includes a third channel configured to receive the first incline support member and a fourth channel configured to receive the second incline support member.

14. The method of claim 13, wherein the first incline support member is configured to slide through the first channel and the second incline support member is configured to slide through the second channel.

15. The method of claim 14, wherein the first incline support member is configured to slide through the third channel and the second incline support member is configured to slide through the fourth channel.

16. The method of claim 11, wherein the fixed bench frame includes predetermined settings for a plurality of different incline levels.

17. The method of claim 11, wherein the fixed bench frame further comprises a locking mechanism capable of locking the first and second pairs of folding legs in a locked and collapsed position.

18. The method of claim 11, wherein the fixed bench frame further comprises a locking mechanism capable of locking the first and second pairs of folding legs in a locked and expanded position.

19. The method of claim 11, wherein the collapsible and adjustable incline exercise bench further comprises a first folding mechanism and a second folding mechanism.

* * * * *